US006711490B2

(12) United States Patent
Kobayashi et al.

(10) Patent No.: US 6,711,490 B2
(45) Date of Patent: Mar. 23, 2004

(54) INTAKE AIR AMOUNT COMPUTING APPARATUS AND METHOD FOR THE SAME, AND INTAKE PRESSURE COMPUTING APPARATUS AND METHOD FOR THE SAME

(75) Inventors: Daisuke Kobayashi, Susono (JP); Harufumi Muto, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 202 days.

(21) Appl. No.: 09/983,731

(22) Filed: Oct. 25, 2001

(65) Prior Publication Data

US 2002/0055814 A1 May 9, 2002

(30) Foreign Application Priority Data

Nov. 8, 2000 (JP) ..... 2000-340626

(51) Int. Cl.[7] ..... G06G 7/70
(52) U.S. Cl. ..... 701/102; 73/118.2; 123/406.52
(58) Field of Search ..... 123/179.16, 179.18, 123/505, 406.52; 73/118.2; 701/101, 102, 103

(56) References Cited

U.S. PATENT DOCUMENTS

| | | | | |
|---|---|---|---|---|
| 4,870,942 A | * | 10/1989 | Shibata et al. | 123/676 |
| 5,003,950 A | * | 4/1991 | Kato et al. | 123/406.46 |
| 5,481,462 A | * | 1/1996 | Nagai | 701/101 |
| 5,615,657 A | * | 4/1997 | Yoshizawa | 123/494 |
| 5,728,932 A | * | 3/1998 | Uchikawa | 73/118.2 |

FOREIGN PATENT DOCUMENTS

| | | |
|---|---|---|
| JP | A 7-293297 | 11/1995 |
| JP | A 9-158762 | 6/1997 |

* cited by examiner

*Primary Examiner*—Willis R. Wolfe
*Assistant Examiner*—Johnny H. Hoang
(74) *Attorney, Agent, or Firm*—Oliff & Berridge, PLC

(57) ABSTRACT

An intake pressure computing apparatus and a method for the same compute an intake pipe pressure P0 based on a sum of a throttle passing air amount QA0 calculated based on at least a throttle opening and a flow of purge air that flows into an intake pipe through a purge passage, or a purge flow rate QP, and compute an intake pipe pressure P3 using an intake air amount QA based on an output from an air flow meter. An intake air amount computing apparatus and a method for the same compute an amount of air drawn into an engine, or an intake air amount, based on the intake pipe pressure P0 and the intake pipe pressure P3.

12 Claims, 6 Drawing Sheets

INTAKE AIR AMOUNT COMPUTING APPARATUS AND METHOD FOR THE SAME, AND INTAKE PRESSURE COMPUTING APPARATUS AND METHOD FOR THE SAME

INCORPORATION BY REFERENCE

The disclosure of Japanese Patent Application No. 2000-340626 filed on Nov. 8, 2000 including the specification, drawings and abstract is incorporated herein by reference in its entirety.

BACKGROUND OF THE INVENTION

1. Field of the Invention

The invention relates to an intake air amount computing apparatus for computing an amount of air drawn into an internal combustion engine and a method for the same, and an intake pressure computing apparatus for computing an intake pressure of an intake pipe connected to the internal combustion engine and a method for the same.

2. Description of the Related Art

An engine control apparatus has been known as an apparatus for computing the amount of air drawn into the internal combustion engine, as disclosed, for example, in Japanese Patent Application Laid-Open HEI 9-158762. The engine control apparatus for computing a first variation per unit time based on a measured intake air amount and a second variation per unit time based on a throttle passing air amount obtained through arithmetic operations and, by comparing the first variation with the second variation, corrects a cylinder inflow air amount. This engine control apparatus aims to eliminate any delay in the control system by correcting the cylinder inflow air amount through the comparison made between the first variation and the second variation.

However, in the above-mentioned apparatus, the cylinder inflow air amount is computed on the assumption that all air flowing into the cylinder passes through the throttle, which could result at times in incorrect computation of the cylinder inflow air amount. If a passage through which air is supplied to the cylinder is constructed so that air drawn in from another passage without passing through the throttle valve joins the main inflow in conjunction, for example, with a purge or EGR, an error is introduced to the cylinder inflow air amount, which causes computation of the inflow air amount to be inaccurate.

SUMMARY OF THE INVENTION

In viewing the foregoing technical problems, it is therefore an object of one aspect of the invention to provide an intake air amount computing apparatus with improved accuracy in computing the intake air amount and a method for the same, and an intake pressure computing apparatus with improved accuracy in computing the intake pressure and a method for the same.

Namely, an intake air amount computing apparatus and a method for the same according to a first aspect of the invention compute a first intake pipe pressure based on a sum of, at least, a throttle passing air amount calculated based on a throttle opening and an amount of air that flows into the intake pipe through a passage other than passage through a throttle valve. The intake air amount computing then compute a second intake pipe pressure based on an output from an air flow meter, and compute, based on the first intake pipe pressure and the second intake pipe pressure, an amount of air drawn into an internal combustion engine.

The first intake pipe pressure may also be computed by the first intake pipe pressure computing device based on a sum of the throttle passing air amount and a flow of purge air that flows into the intake pipe through a purge passage.

The first intake pipe pressure may also be computed by the first intake pipe pressure computing device based on a sum of the throttle passing air amount and an amount of exhaust gases that flow into the intake pipe through an exhaust gas recirculation passage, or an exhaust gas inflow amount.

An intake pressure computing apparatus and a method for the same according to a first aspect of the invention compute a first intake pipe pressure based on a sum of, at least, a throttle passing air amount calculated based on a throttle opening and an amount of air that flows into the intake pipe through a passage other than that through a throttle valve. The intake pressure computing apparatus then computes a second intake pipe pressure based on an output from an air flow meter, and compute, based on the first intake pipe pressure and the second intake pipe pressure, a pressure in the intake pipe.

The first intake pipe pressure may also be computed based on the sum of the throttle passing air amount and the flow of purge air that flows into the intake pipe through the purge passage.

The first intake pipe pressure may also be computed based on the sum of the throttle passing air amount and the amount of exhaust gases that flow into the intake pipe through the exhaust gas recirculation passage, or the exhaust gas inflow amount.

According to these aspects, the intake air amount is computed including the air that flows into the internal combustion engine through the purge passage or the like to join the main inflow without passing through the throttle valve. This enables accurate computation of the intake air amount or the intake pipe pressure even with the intake air that flows into the internal combustion engine without passing through the throttle valve.

In addition, in place of the output of the air flow meter with a response delay and the purge flow rate without any response delay being directly added up, a specific intake pipe pressure is computed using the air flow meter output or the purge air flow individually so as to compute the intake air amount and the intake pipe pressure based on each of these intake pipe pressure values. This enables accurate computation of the intake air amount and the intake pipe pressure, without causing an error due to incompatibility between the air flow meter with a response delay and the purge flow rate without any response delay.

DETAILED DESCRIPTION OF THE PREFERRED EMBODIMENTS

Hereafter, the embodiments of the invention will be explained in details with reference to the attached drawings.

Figure 1:
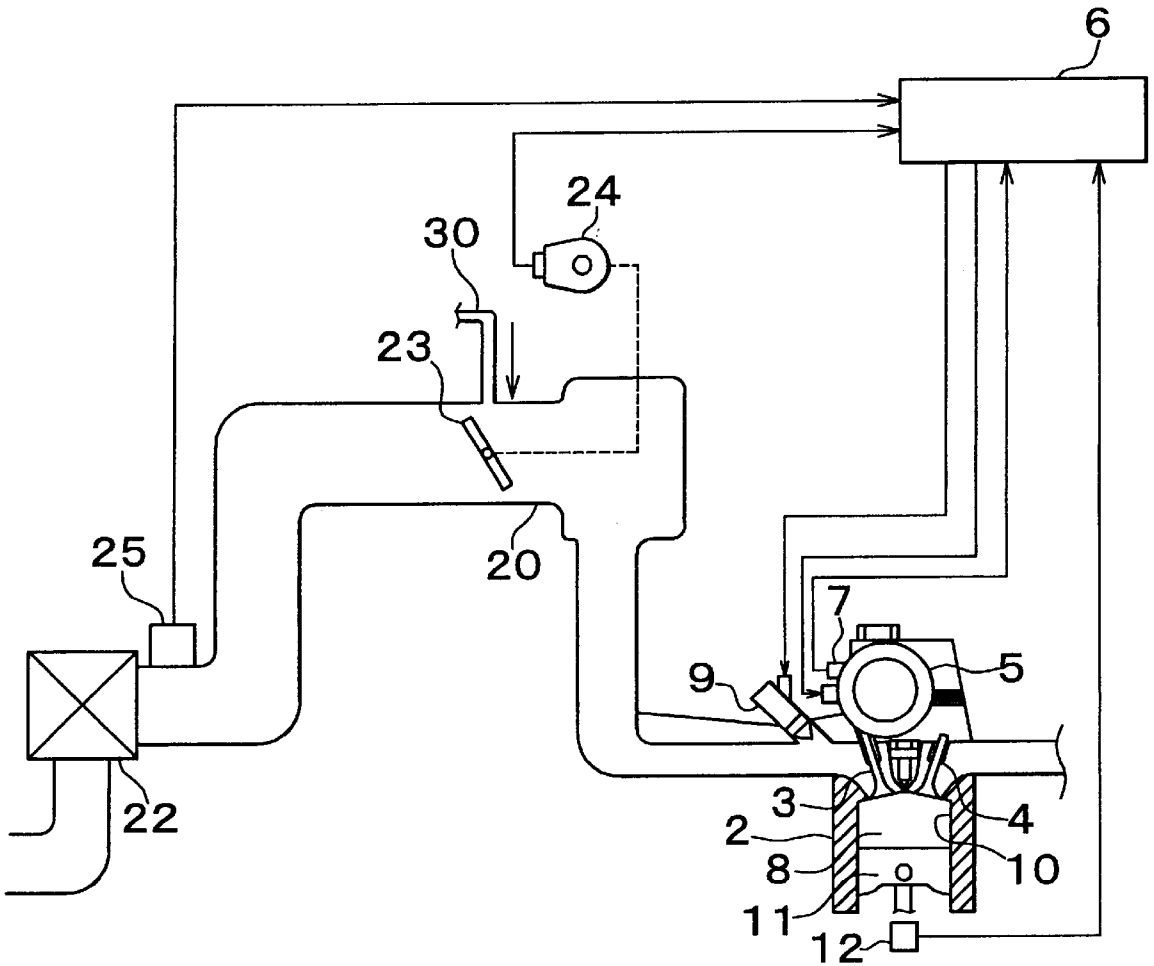
FIG. 1 is an explanatory drawing of the intake air amount computing apparatus according to the first embodiment of the invention.

FIG. 1 is an explanatory drawing of an intake air amount computing apparatus according to a first embodiment of the invention.

Referring to FIG. 1, the intake air amount computing apparatus computes an amount of intake air drawn into cylinders of an engine 2, the internal combustion engine. The engine 2, which is subjected to computation of the intake air amount according to the invention, is for example provided with a variable valve train mechanism. A variable valve timing mechanism 5 that varies opening and closing timings of an intake valve 3 and an exhaust valve 4 are provided as the variable valve train mechanism. The variable valve timing mechanism 5, electrically connected to an ECU 6, is operated by a control signal output from the ECU 6, outputs a detection signal on the valve timing information via a detection sensor 7 such as a cam position sensor to the ECU 6.

The engine 2 is provided with a crank position sensor 12. The crank position sensor 12 detects an engine speed and is connected to the ECU 6 to output a detection signal to the ECU 6.

There is provided in the engine 2 an injector 9 that injects fuel into a combustion chamber 8. The injector 9 is a fuel injection device that supplies the combustion chamber 8 with fuel, disposed for each cylinder 10 provided in the engine 2. The combustion chamber 8 is formed above a piston 11 arranged inside the cylinder 10. There are arranged the intake valve 3 and the exhaust valve 4 above the combustion chamber 8.

An intake pipe 20 comprising an intake pipe, a surge tank, or the like is connected to an upstream side of the intake valve 3. A throttle valve 23 is provided in the middle of the intake pipe 20. The throttle valve 23 is operated based on a control signal from the ECU 6. A throttle opening of the throttle valve 23 is detected by a throttle position sensor 24 and input to the ECU 6.

An air cleaner 22 is installed on an upstream side of the throttle valve 23 in the intake pipe 20. An air flow meter 25 is provided on a downstream position of the air cleaner 22. The air flow meter 25 detects the intake air amount. A detection signal of the air flow meter 25 is input to the ECU 6.

The ECU 6 controls the entire system of the intake air amount computing apparatus 10, a core component of which being a computer comprising a CPU, ROM, and RAM. The ROM stores various types of control routines including an intake air amount prediction routine.

A purge passage 30 merges into the intake pipe 20 at a downstream portion of the throttle valve 23. The purge passage 30 allows a predetermined amount of air to flow into the engine 2 without passing through the throttle valve 23. It is connected to a charcoal canister (not shown) so as to introduce a fuel evaporative emission from the charcoal canister into an intake system of the engine 2. This means that the amount of air drawn into the engine 2 is the sum of the amount of air passing through the throttle valve 23 and the amount of air introduced into the intake pipe 20 through the purge passage 30.

An operation of the intake air amount computing apparatus according to the first embodiment of the invention will be explained.

Figure 2:
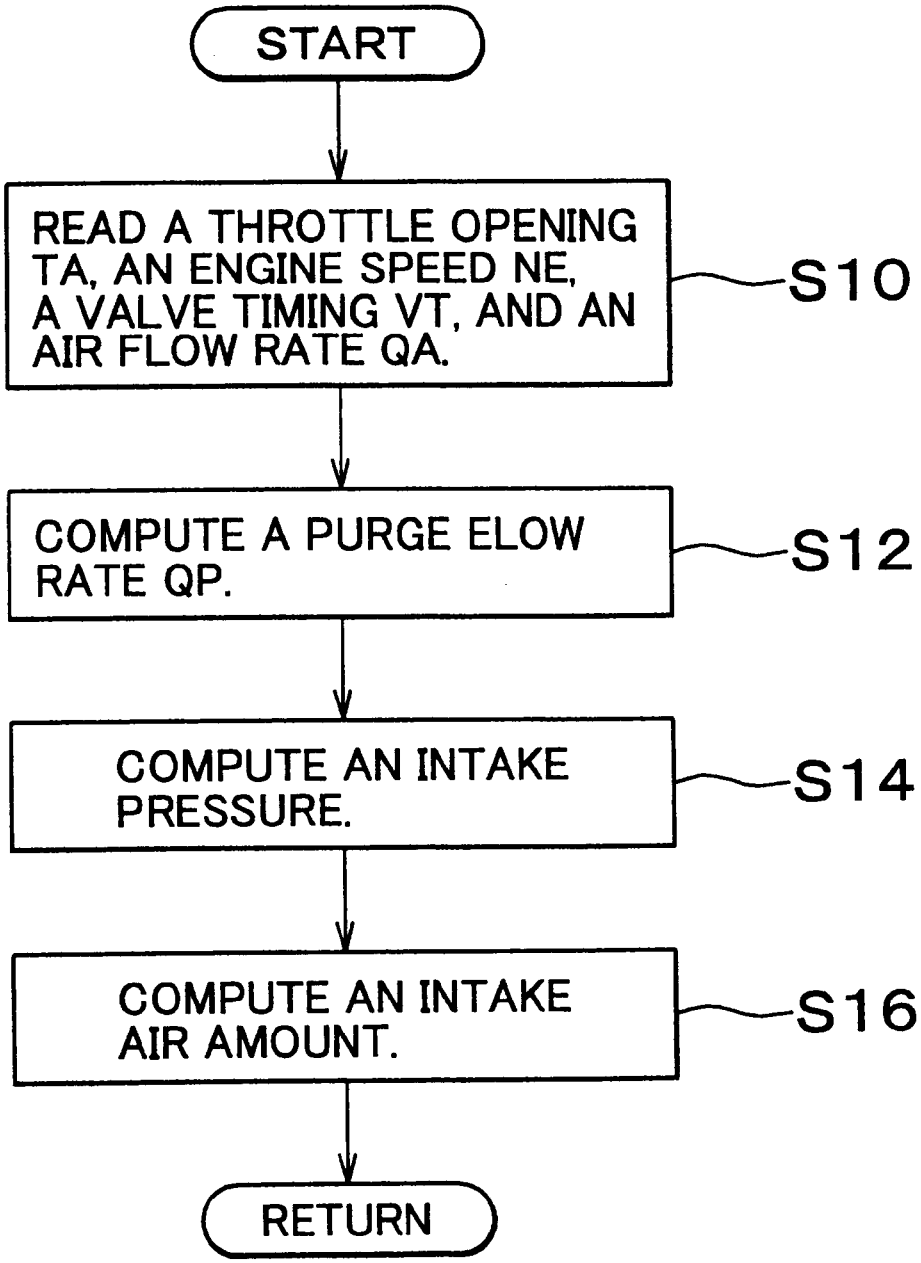
FIG. 2 is a flow chart showing an operation of the intake air amount computing apparatus shown in FIG. 1.

FIG. 2 is a flow chart showing an operation of the intake air amount computing apparatus.

In step S10 of the flow chart, a throttle opening TA, an engine speed NE, a valve timing VT, and an air flow rate QA are read.

The throttle opening TA is read based on an output signal from the throttle position sensor 24. The engine speed NE is read based on an output signal from the crank position sensor 12. The valve timing VT is read based on an output signal from the detection sensor 7. The air flow rate QA is read based on an output signal from the air flow meter 25.

The operation then proceeds to step S12, in which a purge flow rate QP is computed to determine the amount of purge that flows into the intake pipe 20 through the purge passage 30. The purge flow rate QP is calculated through estimation on the basis of output signals from an air-fuel ratio sensor, an oxygen concentration sensor, or other sensor not shown. The operation then proceeds to step S14, in which a pressure of the intake pipe 20, i.e., the intake pressure (intake pipe pressure) is calculated.

Figure 3:
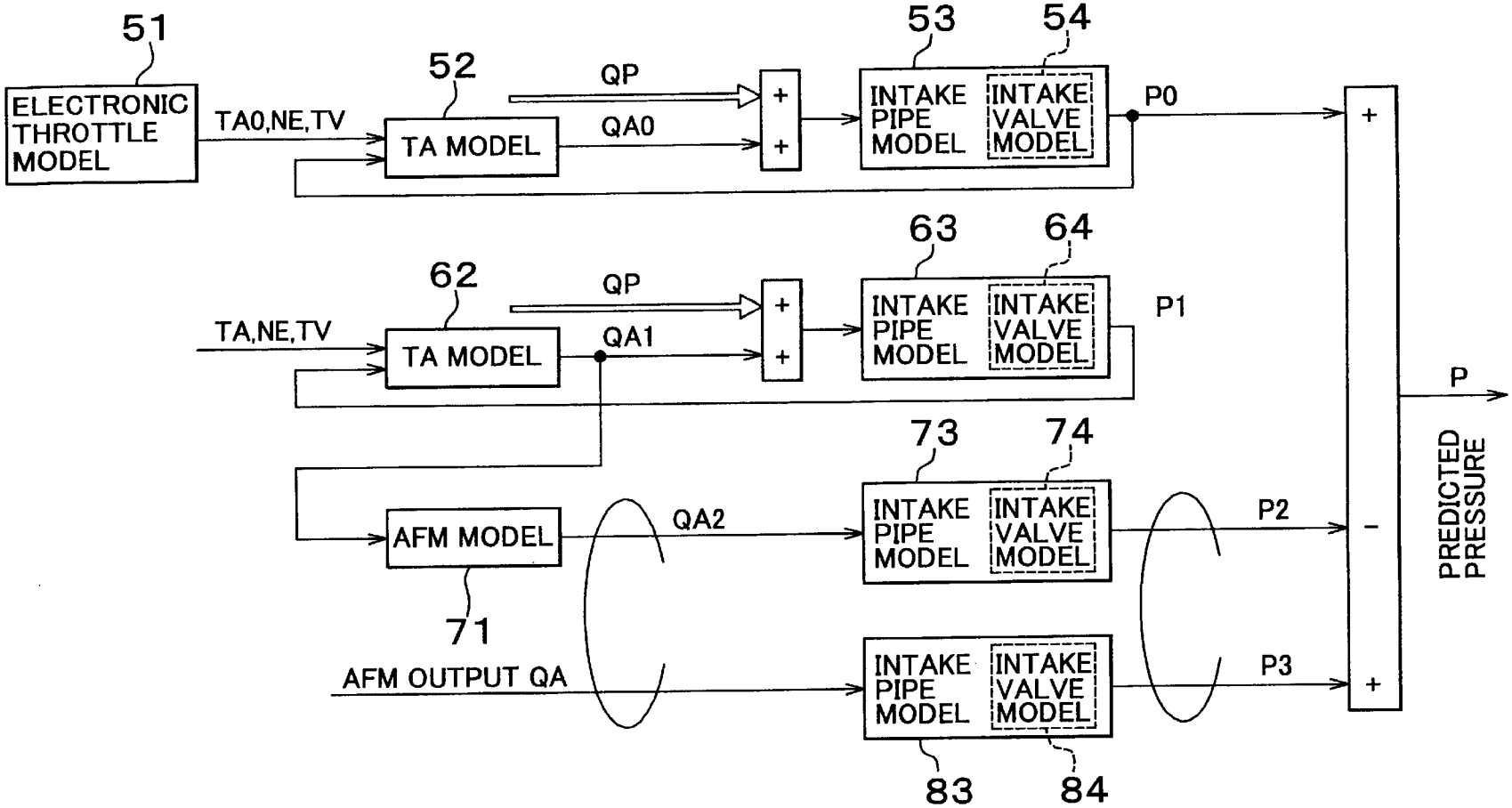
FIG. 3 is a block diagram showing arithmetic operations for finding an intake pressure in the intake air amount computing apparatus shown in FIG. 1.

FIG. 3 is a block diagram showing arithmetic operations for calculating the intake pressure. Referring to FIG. 3, a throttle opening TA0, the engine speed NE, and the valve timing VT are output from an electronic throttle model 51 to a TA model (throttle air model) 52. Here, the throttle opening TA0 represents a throttle opening at a time after the lapse of a predetermined period of time from the present time, which is estimated based on the current throttle opening TA or the like.

An intake pipe predicted pressure P0 output from an intake pipe model 53 is also input to the TA model 52. The TA model 52 uses the throttle opening TA0, the engine speed NE, the valve timing VT, and the intake pipe predicted pressure P0 to compute an air flow rate QA that represents the amount of air passing through the throttle valve. The air flow rate QA0 output from the TA model 52 is added to the purge flow rate QP and the resultant sum is input to the intake pipe model 53.

There is provided an intake valve model 54 in the intake pipe model 53. The input of the inflow air amounts (QA0, QP) allows the intake pipe predicted pressure P0 after the lapse of the predetermined period of time from the present to be calculated according to the laws of conservation of mass and conservation of energy. The intake pipe predicted pressure P0 represents an estimated intake pipe pressure developing when the intake valve 3 closes.

The data of the throttle opening TA, engine speed NE, and valve timing VT are also input to the TA model 62. The TA model 62 is set in the same conditions as the TA model 52.

A current intake pipe pressure P1 output from an intake pipe model 63 is also input to the TA model 62. In the TA model 62, the throttle opening TA, the engine speed NE, the valve timing VT, and the intake pipe pressure P1 are used to compute a current air flow rate QA1 that represents the amount of air currently passing through the throttle valve. The air flow rate QA1 output from the TA model 62 is added to the purge flow rate QP and the resultant sum is input to the intake pipe model 63.

There is provided an intake valve model 64 in the intake pipe model 63. The input of the inflow air amounts (QA1, QP) allows the current intake pipe pressure P1 to be calculated according to the equation of state of gases (P.V=m.R.T). The intake pipe model 63 is set in the same conditions as the intake pipe model 53.

The air flow rate QA1 output from the TA model 62 is input to an air flow meter model (AFM model) 71. The AFM model 71, receiving an input of the current air flow rate QA1, outputs an air flow rate QA2 that represents the current air flow rate QA1 with a detection lag of the air flow meter 25 taken into consideration. Namely, the air flow rate QA2 contains in the air flow rate QA1 in which the detection lag of the air flow meter 25.

The air flow rate QA2 is then input to an intake pipe model 73. An intake valve model 74 is provided in the intake pipe model 73. The input of the inflow air amount (QA2) allows an intake pipe pressure P2 containing therein a time lag to be calculated according to the equation of state of gases (P.V=m.R.T). The intake pipe model 73 is set in the same conditions as the intake pipe models 63, 53.

An air flow rate QA output from the air flow meter 25 is input to an intake pipe model 83. An intake valve model 84 is provided in the intake pipe model 83. The input of the inflow air amount (QA) to the intake pipe model allows an intake pipe pressure P3 containing therein a time lag to be calculated according to the equation of state of gases (P.V=m.R.T). The intake pipe model 83 is set in the same conditions as the intake pipe models 73, 63, 53.

The intake pipe pressure P3 output from the intake pipe model 83 contains therein a time lag as the intake pipe pressure P2 output from the intake pipe model 73 does, having the same response as the intake pipe pressure P2.

The intake pipe pressure P0 output from the intake pipe model 53 is added to, and the intake pipe pressure P2 output from the intake pipe model 73 is subtracted from, the intake pipe pressure P3 output from the intake pipe model 83, thus arriving at an predicted pressure P. The predicted pressure P represents a value that makes up for a difference between the intake pipe pressure P3 calculated based on the output QA of the air flow meter 25, and an actual intake pipe pressure, based on the intake pipe pressures P0, P1 incorporating the purge flow rate QP.

The operation then proceeds to step S16 shown in FIG. 2, in which the intake air amount per unit time when the intake valve 3 is closed is calculated based on the predicted pressure P obtained in step 14. The arithmetic operation of the intake air amount is performed using a map and an arithmetic expression previously set in the ECU 6.

As apparent from the foregoing, in the intake air amount computing apparatus according to the embodiment, the intake air amount is computed by taking into consideration the intake air that flows into the engine 2 through the purge passage 30, but not through the throttle valve 23. This enables accurate computation of the intake air amount even when there is intake air that flows into the engine 2 without passing through the throttle valve 23.

In place of the output QA from the air flow meter 25 with a response delay and the purge flow rate QP without any response delay being added up, intake pipe pressures P0 to P4 are computed using the air flow meter output QA or the purge air flow QP individually so as to compute the intake air amount or the intake pipe pressure based on each of these intake pipe pressure values. This enables accurate computation of the intake air amount and the intake pipe pressure, without causing an error due to incompatibility between the air flow meter with a response delay and the purge flow rate without any response delay.

Next, an intake air amount computing apparatus according to a second embodiment of the invention will be explained.

Figure 4:
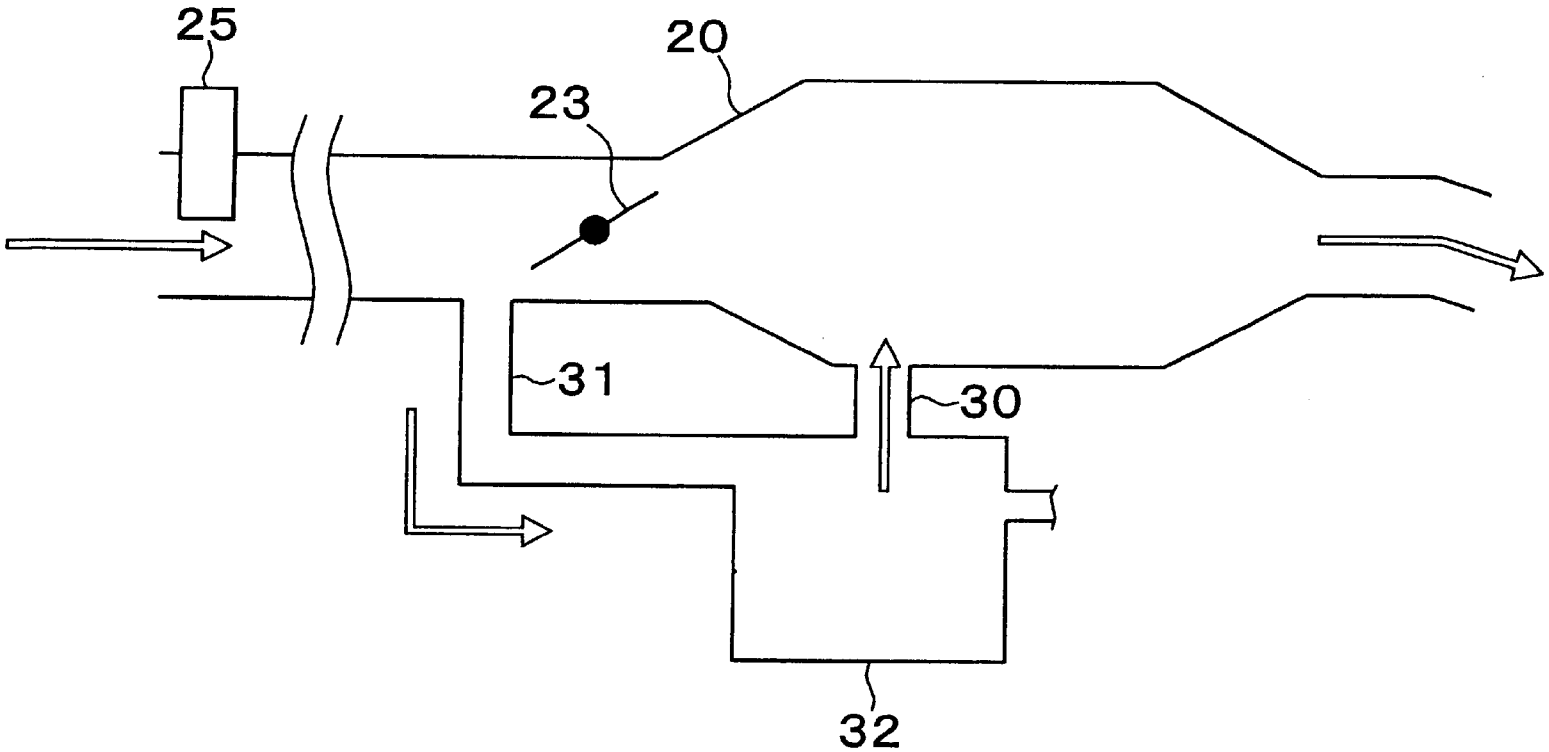
FIG. 4 is an explanatory drawing of the intake air amount computing apparatus according to the second embodiment of the invention.

The intake air amount computing apparatus according to the second embodiment is of almost the same configuration as the intake air amount computing apparatus according to the first embodiment, except that an upstream portion 31 of a purge passage 30 communicates with an intake pipe 20 at an upstream position of a throttle valve provided therein as shown in FIG. 4. As shown in FIG. 4, the purge passage 30 connects an upstream passage of the throttle valve 23 to a downstream passage of the throttle valve through a charcoal canister 32.

Figure 5:
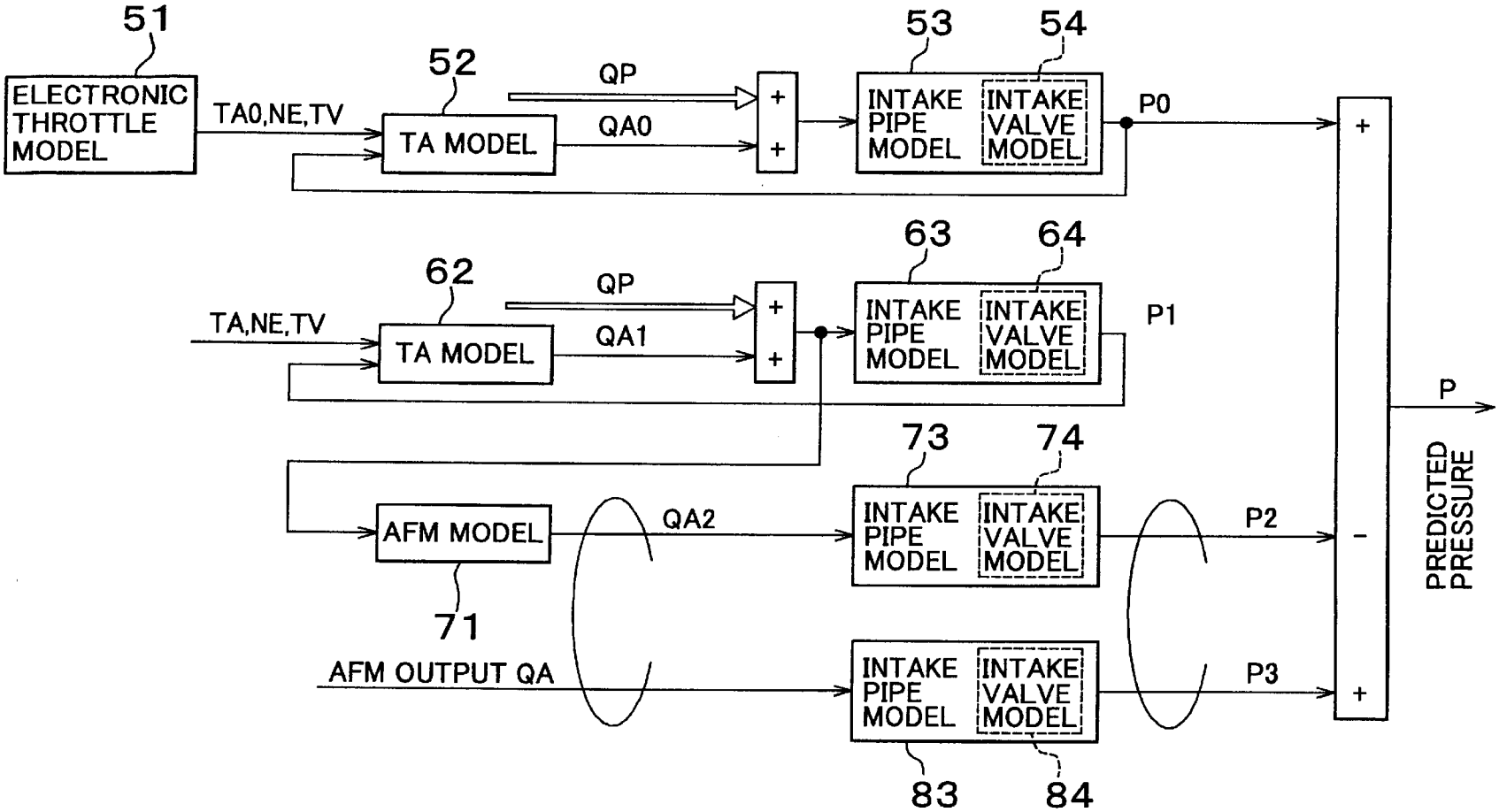
FIG. 5 is a block diagram showing arithmetic operations for finding an intake pressure in the intake air amount computing apparatus according to the second embodiment of the invention.

FIG. 5 is a block diagram showing arithmetic operations performed in the intake air amount computing apparatus according to the second embodiment of the invention. Referring to FIG. 5, the block configuration for arithmetic operations for finding the intake pressure by the intake air amount computing apparatus according to the second embodiment is of the same construction as that for the first embodiment shown in FIG. 3, except that an air flow rate input to an AFM model 71 is the sum of a purge flow rate QP and an air flow rate QA1 computed by a TA model 62.

Such a configuration for arithmetic operations for computing the intake air amount enables accurate computation of the intake air amount in accordance with the purge passage 30 is configured as shown in FIG. 4. In addition, in the intake air amount computing apparatus according to the second embodiment, the intake air amount is also computed when there is intake air that flows into the engine 2 through the purge passage 30 without passing through the throttle valve 23 taken into consideration, as in the intake air amount computing apparatus according to the first embodiment. This ensures accurate computation of the intake air amount even when there is intake air that flows into the engine 2 without passing through the throttle valve 23.

Moreover, in place of an output QA from an air flow meter 25 with a response delay and the purge flow rate QP without any response delay being directly added up, intake pipe pressures P0, P1 may be computed by adding an air flow rate QA0 after the lapse of a predetermined period of time obtained through arithmetic operations, a current air flow rate QA1, and the purge flow rate QP. This minimizes a calculation error arising from a difference in response time.

Hereafter, an intake air amount computing apparatus according to a third embodiment of the invention will be explained.

The intake air amount computing apparatus according to the third embodiment is applicable to computation of an intake air amount with an engine 2 provided with an EGR (Exhaust Gas Recirculation) device.

Figure 6:
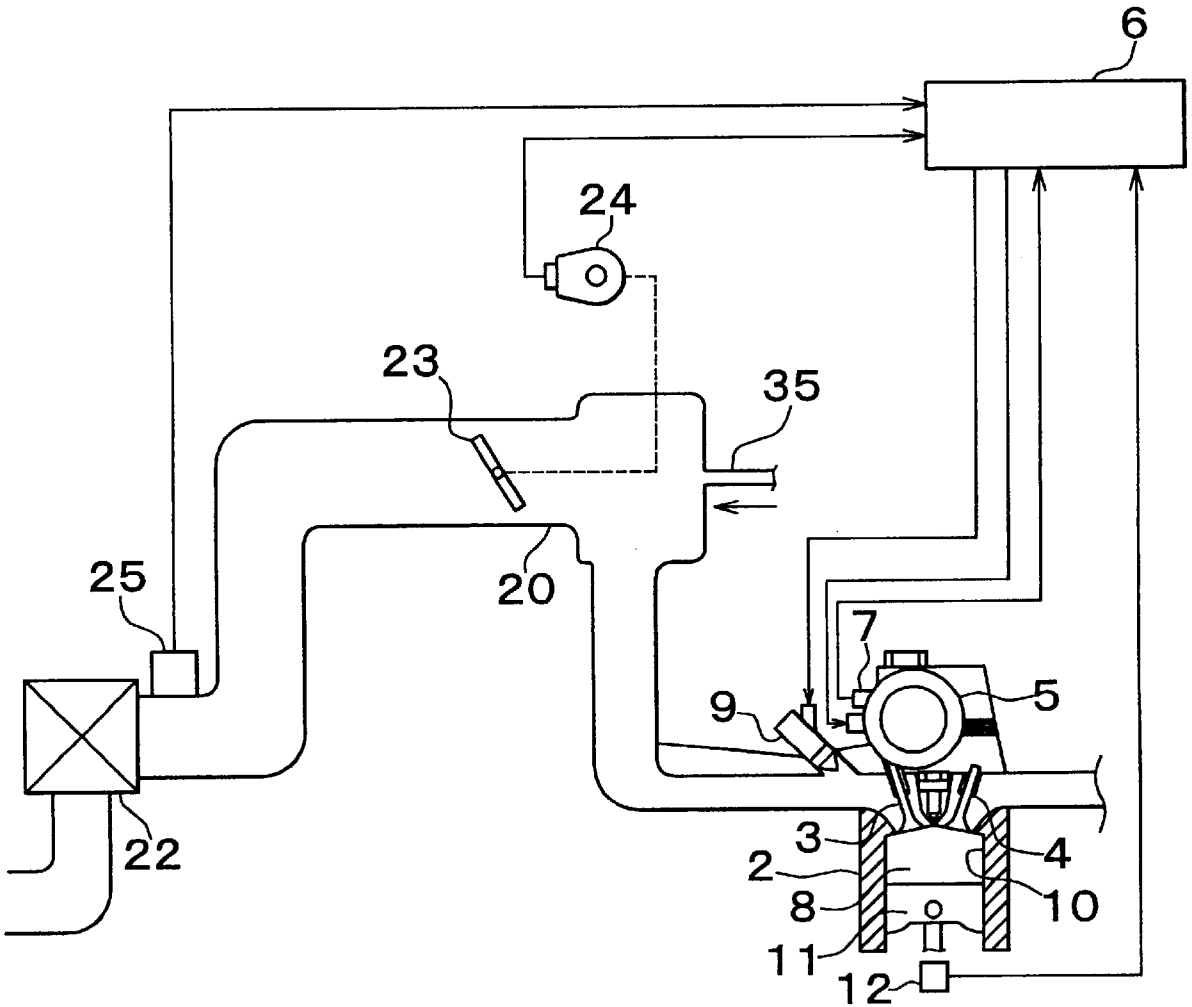
FIG. 6 is an explanatory drawing of the intake air amount computing apparatus according to the third embodiment of the invention.

Referring to FIG. 6, an exhaust gas recirculation passage 35 is connected to an intake pipe 20 at a midway point of an entire length thereof. As in the above-mentioned purge passage 30, air that does not pass through a throttle valve 23 is drawn into the engine 2. Computation of the intake air amount is therefore performed by replacing the above-mentioned purge flow rate QA with an exhaust gas inflow amount. This enables accurate computation of the intake air amount as in the intake air amount computing apparatus according to the first embodiment of the invention.

The intake air amount computing apparatus according to the invention is not limited to a case where an EGR device is installed as aforementioned or where a purge is involved as in the first embodiment, but may be applied to any case as long as air flows into the intake pipe 20 without passing through the throttle valve 23.

The intake air amount computing apparatus according to the invention will be explained.

The intake air amount computing apparatus according to the first to third embodiments as above described may also be an intake pressure computing apparatus, in which the ECU 6 thereof performs arithmetic operations of up to S14 (intake pressure computation) in FIG. 2. Even in such a configuration, the same effects can be obtained as those of the first to third embodiments, if the intake air amount is computed based on the intake pressure computed by the intake pressure computing apparatus.

In the illustrated embodiment, the controller (the ECU 6) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An intake air amount computing apparatus for computing an intake air amount, or an amount of air drawn into an internal combustion engine, comprising:

a first intake pipe pressure computing device that computes a first intake pipe pressure based on a sum of, at least, a throttle passing air amount calculated based on a throttle opening and an amount of air that flows into an intake pipe through a passage other than a passage through a throttle valve;

a second intake pipe pressure computing device that computes a second intake pipe pressure based on an output from an air flow meter; and an intake air amount computing device that computes, based on the first intake pipe pressure and the second intake pipe pressure, an amount of air drawn into the internal combustion engine.

2. The intake air amount computing apparatus according to claim 1, wherein:

the first intake pipe pressure computing device computes the first intake pipe pressure based on a sum of the throttle passing air amount and an amount of flow of purge air that flows into the intake pipe through a purge passage.

3. The intake air amount computing apparatus according to claim 1, wherein:

the first intake pipe pressure computing device computes the first intake pipe pressure based on a sum of the throttle passing air amount and an amount of exhaust gases that flow into the intake pipe through an exhaust gas recirculation passage.

4. An intake air amount computing method that computes an intake air amount, or an amount of air drawn into an internal combustion engine, comprising the steps of:

computing a first intake pipe pressure based on a sum of, at least, a throttle passing air amount calculated based on a throttle opening and an amount of air that flows into an intake pipe through a passage other than that through a throttle valve;

computing a second intake pipe pressure based on an output from an air flow meter; and computing an amount of air drawn into the internal combustion engine based on the first intake pipe pressure and the second intake pipe pressure.

5. The method according to claim 4, wherein:

the first intake pipe pressure is computed based on a sum of the throttle passing air amount and an amount of flow of purge air that flows into the intake pipe through a purge passage.

6. The method according to claim 4, wherein:

the first intake pipe pressure is computed based on a sum of the throttle passing air amount and an amount of exhaust gases that flow into the intake pipe through an exhaust gas recirculation passage.

7. An intake pressure computing apparatus for computing a pressure in an intake pipe connected to an internal combustion engine, comprising:

a first intake pipe pressure computing device that computes a first intake pipe pressure based on a sum of, at least, a throttle passing air amount calculated based on a throttle opening and an amount of air that flows into the intake pipe through a passage other than a passage through a throttle valve;

a second intake pipe pressure computing device that computes a second intake pipe pressure based on an output from an air flow meter; and an intake pressure computing device that computes a pressure in the intake pipe based on the first intake pipe pressure and the second intake pipe pressure.

8. The intake pressure computing apparatus according to claim 7, wherein:

the first intake pipe pressure computing device computes the first intake pipe pressure based on a sum of the throttle passing air amount and an amount of flow of purge air that flows into the intake pipe through a purge passage.

9. The intake pressure computing apparatus according to claim 7, wherein:

the first intake pipe pressure computing device computes the first intake pipe pressure based on a sum of the throttle passing air amount and an amount of exhaust gases that flow into the intake pipe through an exhaust gas recirculation passage.

10. An intake pressure computing method that computes a pressure in an intake pipe connected to an internal combustion engine, comprising the steps of:

computing a first intake pipe pressure based on a sum of, at least, a throttle passing air amount calculated based on a throttle opening and an amount of air that flows into an intake pipe through a passage other than a passage through a throttle valve;

computing a second intake pipe pressure based on an output from an air flow meter; and computing a pressure in the intake pipe based on the first intake pipe pressure and the second intake pipe pressure.

11. The method according to claim 10, wherein:

the first intake pipe pressure is computed based on a sum of the throttle passing air amount and an amount of flow of purge air that flows into the intake pipe through a purge passage.

12. The method according to claim 10, wherein:

the first intake pipe pressure is computed based on a sum of the throttle passing air amount and an amount of exhaust gases that flow into the intake pipe through an exhaust gas recirculation passage.

* * * * *